US011047151B2

(12) United States Patent
Cheng

(10) Patent No.: US 11,047,151 B2
(45) Date of Patent: Jun. 29, 2021

(54) SURFACE MOUNTED BARN DOOR PRIVACY LOCK

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 211 days.

(21) Appl. No.: 16/141,067

(22) Filed: Sep. 25, 2018

(65) Prior Publication Data

US 2019/0024407 A1 Jan. 24, 2019

Related U.S. Application Data

(63) Continuation-in-part of application No. 15/616,752, filed on Jun. 7, 2017, now Pat. No. 10,081,966.

(60) Provisional application No. 62/412,682, filed on Oct. 25, 2016.

(51) Int. Cl.

| | |
|---|---|
| ***E05B 15/02*** | (2006.01) |
| ***E05B 17/00*** | (2006.01) |
| ***E05B 63/00*** | (2006.01) |
| ***E05B 65/08*** | (2006.01) |
| ***E05B 17/20*** | (2006.01) |
| *E05B 9/08* | (2006.01) |
| *E05B 15/00* | (2006.01) |

(52) U.S. Cl.

CPC ..... *E05B 15/029* (2013.01); *E05B 17/0008* (2013.01); *E05B 17/2069* (2013.01); *E05B 63/0052* (2013.01); *E05B 63/0069* (2013.01); *E05B 65/0864* (2013.01); *E05B 9/08* (2013.01); *E05B 15/006* (2013.01)

(58) Field of Classification Search

CPC ..... E05B 65/0007; E05B 65/0864; E05B 63/0069; E05B 65/08; E05B 15/029; E05B 17/0008; E05B 17/2069; E05B 63/0052; E05B 9/08; E05B 15/006; E05Y 2900/132; E05C 7/00; E05C 19/028; A01K 1/0017; Y10T 292/68; Y10T 70/5173; Y10T 70/519; Y10S 292/29; E06B 11/02

See application file for complete search history.

(56) References Cited

U.S. PATENT DOCUMENTS

| | | | | |
|---|---|---|---|---|
| 2,529,009 | A * | 11/1950 | Foss | E05C 3/042 292/202 |
| 2,793,062 | A * | 5/1957 | Fleming | E05C 3/042 292/57 |
| 3,388,937 | A * | 6/1968 | Wirsig | E05C 5/02 292/62 |
| 7,798,544 | B1 * | 9/2010 | Bates | E05C 1/04 292/340 |
| 7,942,027 | B1 * | 5/2011 | Cassini | E05B 65/1086 70/91 |

(Continued)

FOREIGN PATENT DOCUMENTS

CN 206681518 U * 11/2017

*Primary Examiner* — Mark A Williams
(74) *Attorney, Agent, or Firm* — Heisler & Associates

(57) ABSTRACT

A lockcase is mountable upon a surface of a doorway jamb which is selectively closable by a barn door. The lockcase includes a bolt which translates or otherwise moves relative to the lockcase to selectively engage a strike in the barn door. The bolt is actuated by movement of a handle on a lever mounted to the lockcase. In one embodiment, the lever rotates to cause a shuttle to translate and with the bolt mounted to the shuttle. Detents on the shuttle tend to keep the bolt in either a retracted or a deployed position relative to the lockcase and the strike.

6 Claims, 10 Drawing Sheets

(56) References Cited

U.S. PATENT DOCUMENTS

| | | | | |
|---|---|---|---|---|
| 2001/0035058 | A1* | 11/2001 | Wanek | G01R 31/2849 73/865.6 |
| 2003/0226384 | A1 | 12/2003 | Shedd | |
| 2006/0196234 | A1* | 9/2006 | Dolev | E05B 9/08 70/56 |
| 2006/0208496 | A1 | 9/2006 | Kondratuk | |
| 2007/0000293 | A1* | 1/2007 | Daniels | E05B 47/0603 70/134 |
| 2014/0239647 | A1 | 8/2014 | Jadallah et al. | |

* cited by examiner 110
150
120
123
121
153
170
154
144
160
132
125
122
130
143
142
140
180
185
184
200

182
196
187
194
197
168
174
164
166
162
124
126
127
128

242
240

PAT. PENDING
Patent Pending

SURFACE MOUNTED BARN DOOR PRIVACY LOCK

CROSS-REFERENCE TO RELATED APPLICATIONS

This application is a continuation-in-part of U.S. patent application Ser. No. 15/616,752, filed on Jun. 7, 2017 which claims benefit under Title 35, United States Code § 119(e) of U.S. Provisional Application No. 62/412,682 filed on Oct. 25, 2016 and issued as U.S. Pat. No. 10,081,966 on Sep. 25, 2018, incorporated herein by reference in its entirety.

FIELD OF THE INVENTION

The following invention relates to barn doors and locks for barn doors. More particularly, this invention relates to privacy locks for barn doors, and most particularly those types of barn doors utilized within a building interior to provide a privacy lock therewith.

BACKGROUND OF THE INVENTION

Of the many styles of doors, one type of door is referred to as a "barn door." A barn door is provided directly outside of (or inside of) a doorway opening surrounded by a frame including a pair of opposing jambs below a lintel. The barn door is mounted on a sliding track or other support, typically above the opening and with the door suspended from this track or other sliding support. This track is over the door opening and also to a lateral side of the door opening. The barn door slides on the track between an open position (where it is suspended from the track portions which are laterally spaced to the side of the door opening) to a closed position (where the door is suspended from the track where it is located directly above the door opening). Barn doors are particularly useful when space is not available for a pivoting door and where a wall in which the door is located is too thin to accommodate a pocket door or a pocket door is otherwise undesirable. Barn doors can also be selected for aesthetic reasons or for financial reasons, in that the barn door is a rather simple overall style of door.

One problem with such barn doors is that they typically do not include locks associated therewith. Many doorways benefit from having a door which is lockable, at least for privacy purposes, if not for full security purposes. Accordingly, a need exists for a lockset to facilitate the locking of a barn door. Such a lock should beneficially include some form of emergency entry key to defeat the lock from the outside.

Privacy locks are known for pivoting doors and pocket doors which include a handle or knob which rotates and causes a bolt to translate the engage/disengage and lock/unlock the door. However, such known locks have the handle/knob mounted to the door with the bolt engaging/disengaging the doorway jamb. With a barn door, such a known prior art lock is not effective because the door is not aligned coplanar with the wall plane, but rather is offset from the wall plane. Thus, some other solution is needed to the problem of providing a privacy lock on a barn door.

In some instances, barn doors are already installed adjacent to a doorway or otherwise already configured without any locks associated therewith. A further need exists for a lock set or other lock for a barn door which can be easily retrofitted onto a doorway and barn door combination after the barn door has already been installed, or for retrofitting onto a barn door during initial installation, but which barn door and associated doorway were not originally configured to include such a lock. Also, it is desirable that a lock for a barn door be easy to install, in at least some instances, to allow for lower-cost solutions and to allow those with lesser skills to be able to install a barn door privacy lock or other barn door lock.

SUMMARY OF THE INVENTION

With this invention, a lock is provided for a barn door in the form of a lockset which is mountable to a face of a jamb of a doorway, typically on a side of the doorway adjacent to a leading edge (the edge that leads when the barn door is closing) of the barn door when the door is in an open position, but the lock could be on either opposing face of either of the door jambs. The barn door preferably is suspended from above on a sliding (or rolling) rail, but also preferably includes some form of guideway (such as a track element), which is provided on the floor to keep a lower edge of the barn door substantially within a vertical plane while sliding between an open and a closed position. Such track for alignment of the barn door could be provided directly below the rail from which the barn door is suspended and on one or both lateral sides of the frame surrounding the doorway.

The barn door is modified to include a strike therein which receives a bolt of the lockset when the barn door is locked. The strike preferably has a cylindrical shape with a hollow central core. In one embodiment, the strike can be provided from a combination of inner and outer cylindrical pieces which nest together on a common central axis and each include a beveled head on outer ends thereof and with one piece threading into the other so that they can be coaxially brought together from opposite sides of the barn door and threaded one into the other until they tightly attach to the barn door. The barn door would first have a hole drilled therethrough which would receive these inner and outer pieces of the strike.

As an alternative, the barn door could merely have a hole drilled (or otherwise formed) therein at a strategic location to allow for the bolt to be selectively inserted or removed for locking or unlocking of the barn door. The hollow core of the strike can be perfectly cylindrical or could taper at least adjacent to a side thereof facing the passage making up the doorway, or otherwise be slightly oversized so that less than perfect alignment between the lockset and the strike would still facilitate receipt of the bolt into the strike for locking of the barn door.

The lockset of one embodiment of this invention generally includes two major parts including a lockcase and a handling assembly, in addition to the strike. The lockcase includes a body housing a lock mechanism which receives input from a shaft and output to the bolt, and is mounted within a recess in the face of the jamb, on one side of the wall passage adjacent to where the barn door is located and aligned with the strike when the barn door is closed. A second part of the lockset is in the form of a handling assembly which is mounted to the face of the jamb adjacent to the recess and on the face of the jamb which faces into the passage of the doorway. This handling assembly acts as both trim and also supports a handle through which the lockcase can be actuated. In particular, the lockcase includes the body which receives the shaft which is coupled to the handle of the handling assembly. When the handle is rotated, the shaft is also rotated about its long axis and causes an input into the locking mechanism within the body which causes the bolt of the lockset to translate linearly into or out of the strike to lock or unlock the barn door.

The jamb is either entirely hollow or at least includes a sufficient recess within an interior thereof to allow the lockcase to be located therein. In one embodiment, this recess is in the form of a cylindrical hole which extends into the face of the jamb, with this hole located at a height above ground matching a height of the strike in the barn door. The hole is sufficiently large so that it also extends out of an exterior side of the jamb and the entire body and other portions of the lockcase can fit into this hole and for the bolt to be able to extend out of an exterior side of the jamb. The cylindrical hole is covered by portions of the handling assembly at the opening through the face of the jamb and covered by a rim with an annular flair surrounding the body adjacent where the bolt protrudes from the body at the exterior side of the jamb, with this flair, abutting against the exterior surface of the jamb.

A portion of the hole at the inwardly facing face of the jamb receives the handling assembly therein and the handling assembly is appropriately coupled to the lockcase, which typically is inserted through the portion of the hole at the exterior side of the jamb and accessing the common recess, so that the lockcase and handling assembly, when attached together, securely hold each other within the recess. Preferably frame screws are also utilized to directly fasten the handling assembly (and hence also the lockcase) to the frame.

Details of the lockcase and locking mechanism within the body can be taken from lockcase arts where such locking mechanisms are provided for translating a bolt, such as a deadbolt, into and out of a strike on a door jamb from an edge of a standard pivoting door. Other forms of lockcase locking mechanisms could alternatively be utilized known in the prior art or hereafter discovered. While the bolt is preferably of round cross-section and about one centimeter in diameter, it could be larger (or smaller) and non-circular, such as to match known deadbolt cross-sections.

As one example of such a locking mechanism for the lockcase, the shaft coupled to the handle could have a spur gear thereon which interacts with a rack gear coupled to the bolt, so that when the shaft is rotated it causes the rack gear to translate. A size of the spur gear and size of teeth on the rack gear can be selected to control a ratio of shaft turning to bolt translation to match a desired design. In more complex mechanisms, a multi-gear drive train could be interposed between the shaft and post, such as so that a relatively small amount of handle rotation (i.e. 90° of rotation) causes the bolt to translate approximately two centimeters or more, so that a secure locking action can be achieved. The bolt can have a tip threaded to a trunk, both of similar diameter, with the tip threaded concentrically into a threaded bore in the trunk, so that the bolt can be extended and have its length fine tuned by rotating the tip relative to the trunk, and so that bolt length is optimized.

A key is also provided with the overall lockset in a preferred form of the invention. The strike preferably passes entirely through the barn door in this preferred embodiment, so that the key can be placed from outside of the barn door into the strike and push back the post into the body, so that emergency access from an exterior of the barn door can be achieved. The hole on an exterior of the strike can be shaped with a unique shape which will only receive a key of a corresponding shape if desired. As another alternative, the strike could have a blind hollow core which is not accessible from the exterior, such as to provide added security.

The handling assembly generally includes three parts including a base plate, a cover plate and handle. The base plate mounts to the body of the lockcase and the cover plate mounts to the base plate. Furthermore, the base plate preferably has frame screws which fasten directly to the jamb, so that the entire lockcase can be held securely to the jamb through the frame screws holding the base plate to the jamb and with the base plate securely attached to the lockcase.

Attachment of the base plate to the body of the lockcase occurs through two mount screws which thread into mount holes in the body (or into standoffs associated with the body). The base plate has a contour which includes an annular floor with a central hole passing therethrough and with a perimeter edge of the floor having a collar extending perpendicularly therefrom, and with a flange extending radially outwardly from a portion of the collar spaced from the annular floor. This flange and annular floor are preferably in parallel planes offset from each other by a width of the collar.

The hole in a center of the annular floor allows the shaft to pass therethrough and couple to the handle and to the body of the lockcase. Smaller holes in the floor and spaced from the central hole (through which the shaft passes) accommodate the mount screws which pass through the annular surface and then into the mount holes or standoffs associated with the body (or otherwise the base plate is fastened to the body of the lockcase).

Heads of these mount screws are recessed within the base plate in that these heads have a lesser height than a depth of the collar, preferably with over half of a depth of the collar left open, without the mount screw heads extending appreciably into this collar space. Frame screws are preferably provided passing through the flange of the base plate. In the embodiment depicted, four such frame screws are provided which secure the flange of the base plate directly to the face of the jamb around the cylindrical hole forming and/or accessing the recess in the jamb. The frame screws preferably have flat heads and holes in the flange taper as do undersides of the frame screw heads so that the frame screw heads are substantially flush with the flange outer surface when tightened. Alternatively, a shoulder of the cover plate (described below) can be recessed to accommodate the heads of the frame screws.

The cover plate has a contour which matches outer portions of the base plate and the cover plate is attachable to the base plate. In particular, the cover plate also includes a circular flat shroud surface similar in size to the annular floor and oriented to be parallel with the annular floor of the base plate. A ring extends perpendicularly from a perimeter of the shroud surface of the cover plate with an outer portion of this collar having a shoulder extending radially therefrom and in a plane parallel with the shroud surface. The ring of the cover plate has a lesser depth than the collar of the base plate, so that when the circular flat shroud surface is nested within the recess inboard of the collar of the base plate, a spacing still exists between the circular shroud surface of the cover plate and the annular floor of the base plate which accommodates the heads of the mount screws.

The collar of the base plate includes female threads formed thereon and the ring of the cover plate includes male threads formed thereon. Thus, the cover plate is attachable to the base plate by threadable attachment and rotation of the cover plate to cause engagement of the threads of the ring with the threads of the collar. In this manner, the cover plate can cover all of the frame screws and mount screws and leave a clean exterior finish for the lockset, according to one embodiment of the invention.

A center of the circular flat shroud surface of the cover plate has a hole therein through which the shaft extends and supports a lever or other user engaging portions of the handle. The handle is recessed within the ring sufficiently so that the handle does not extend into the doorway (or only slightly extends into the doorway). Fingers of a user can reach into this recess in the ring to grip the handle and rotate the handle to cause translation of the bolt for locking or unlocking of the barn door. The handle of the embodiment shown is a basic bar handle fixed to the shaft at its center. Other forms of handles known in the prior art could be used as well with appropriate user engaging portions. The handle typically rotates to cause bolt translation, but could be a sliding or otherwise translating handle leading to bolt translation.

In a further embodiment, a lock is provided for a barn door which is mountable upon a surface of a doorway jamb. Such a surface mountable barn door lock avoids the need to cut a hole in the jamb or otherwise construct or modify the jamb to receive the lock set internally therein. Such a surface mountable lock that can include a lockcase such as with a base plate and cover together forming the lockcase, and with the base plate screwed or otherwise fastened to the jamb. A bolt is movable relative to the lockcase between a retracted and a deployed position. In one embodiment, the bolt is mounted to a shuttle and the bolt and shuttle slide together relative to the lockcase. A lever within the lockcase pivots and engages the shuttle to cause the shuttle to translate when the lever pivots. A handle on the lever extends out of the lockcase and is manually actuatable to position the bolt in either the deployed (locked) position or in the retracted (unlocked) position. In such an embodiment, the strike in the barn door could be similar to other strikes disclosed herein.

OBJECTS OF THE INVENTION

Accordingly, a primary object of the present invention is to provide a privacy lock for a barn door.

Another object of the present invention is to provide a barn door for a doorway passage which includes a privacy lock.

Another object of the present invention is to provide a method for locking a barn door.

Another object of the present invention is to provide a method for providing emergency access through a locked barn door.

Another object of the present invention is to provide a method for installing a lockset into a barn door.

Another object of the present invention is to provide a barn door lock which can be disabled from an outer side thereof in an emergency.

Another object of the present invention is to provide a barn door lock which can be used by a disabled individual.

Another object of the present invention is to provide a privacy lock for a barn door which has a recessed handle to prevent significant blocking of the doorway.

Another object of the present invention is to provide a privacy lock for a barn door which is easy to use and which has a desirable aesthetic appearance, such as an appearance with no fasteners showing.

Another object of the present invention is to provide a lock for a barn door which can be easily installed on an existing door jamb and into an existing barn door.

Another object of the present invention is to provide a lock for a barn door which can be mounted to a surface of a door jamb, rather than requiring embedding into the door jamb.

Another object of the present invention is to provide a privacy door lock for a barn door which has a handle of different sizes to accommodate disabled users.

Another object of the present invention is to provide a door lock for a barn door which tends to maintain a position with a bolt thereof either in a deployed position or in a retracted position.

Other further objects of the present invention will become apparent from a careful reading of the included drawing figures, the claims and detailed description of the invention.

DESCRIPTION OF THE PREFERRED EMBODIMENT

Figure 1:
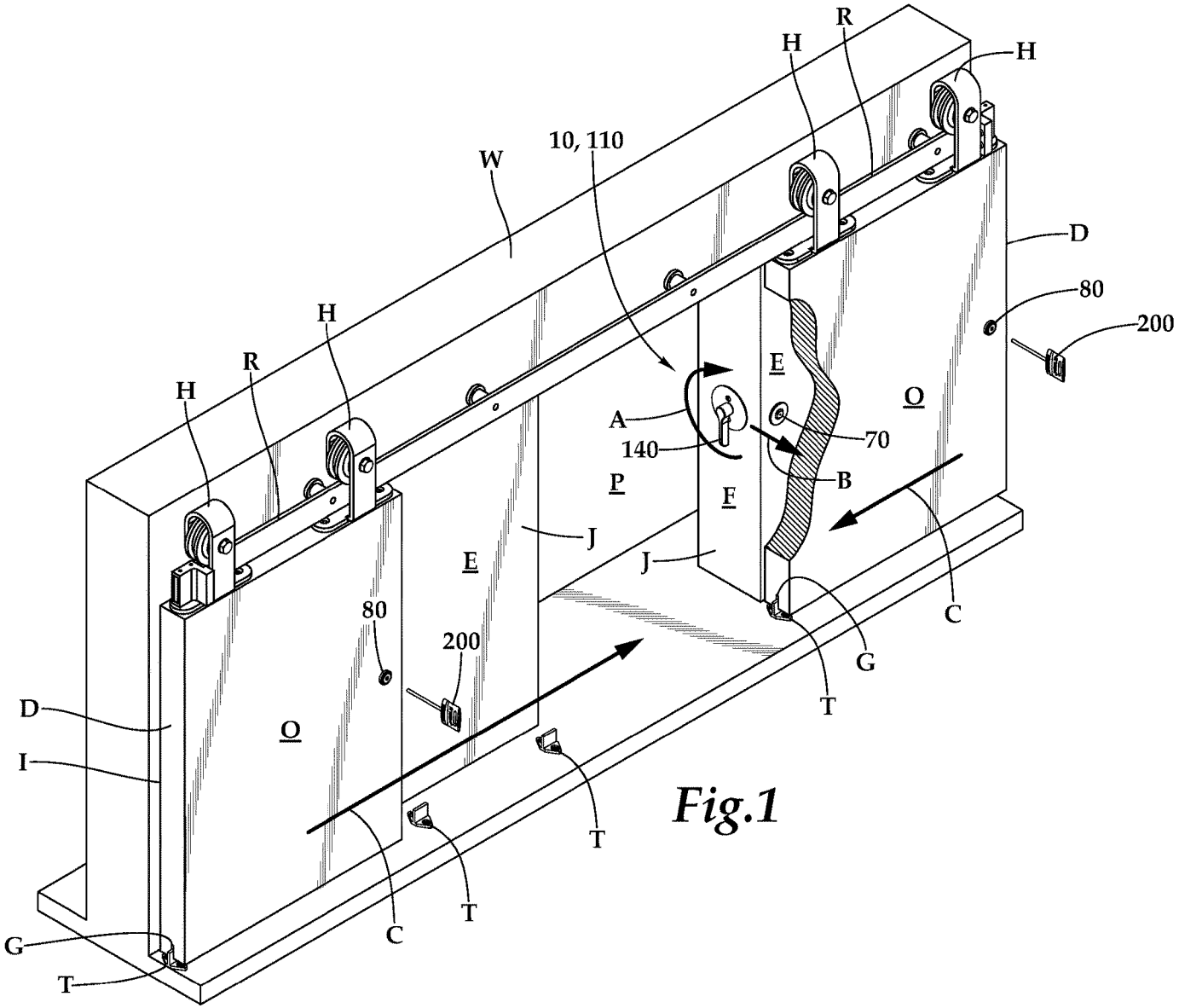
FIG. 1 is a perspective view of a wall with a doorway therein the head with a barn doors mounted adjacent thereto (one sliding from the left and one sliding from the right to illustrate two barn door positioning options), and with a privacy door lock according to this invention shown therewith, for locking of a leading edge or a trailing edge of a barn door.

Referring to the drawings, wherein like reference numerals represent like parts throughout the various drawing figures, reference numeral 10, 110 is directed to a lockset (FIGS. 1-3) that can be mounted within a jamb J adjacent to a doorway passage P passing through a wall W, with a barn door D for closing of the doorway passage P having a strike 80, 180 therein for receiving a bolt 70, 170 for selectively locking the barn door D. The locks 10, 110 are configured to be mounted so that a handle 40, 140, 240 thereof is accessible through a face F of the jamb J.

Figure 7:
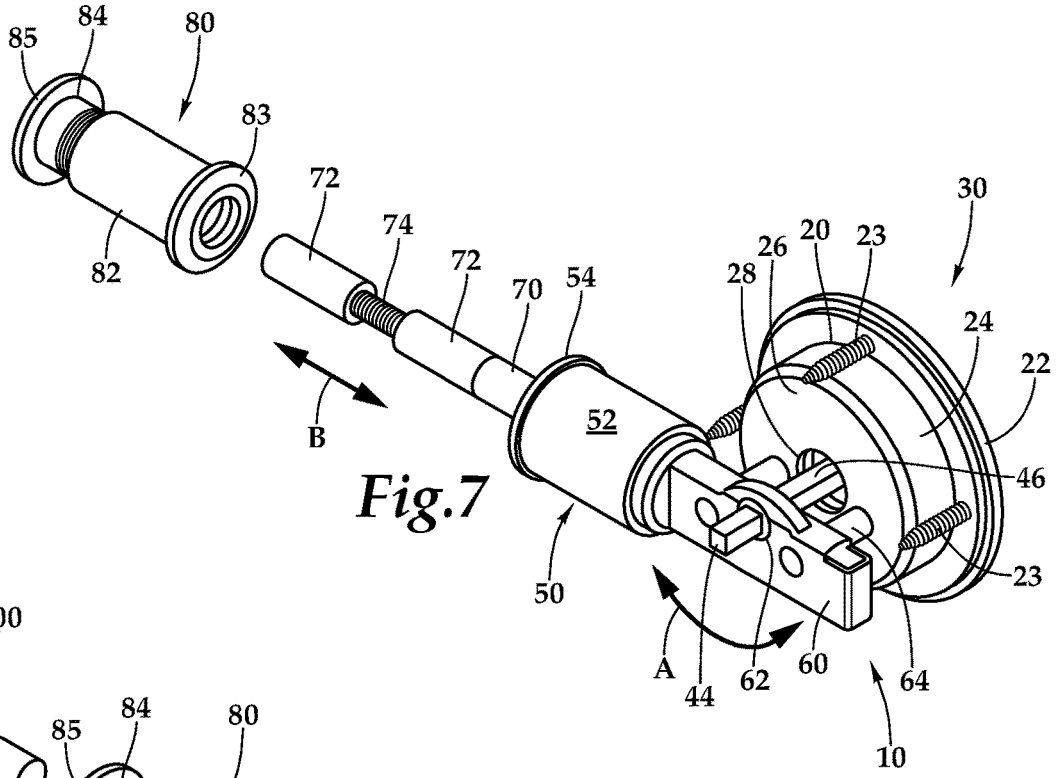
FIG. 7 is a rear perspective view of that which is shown in FIG. 5.
Figure 8:
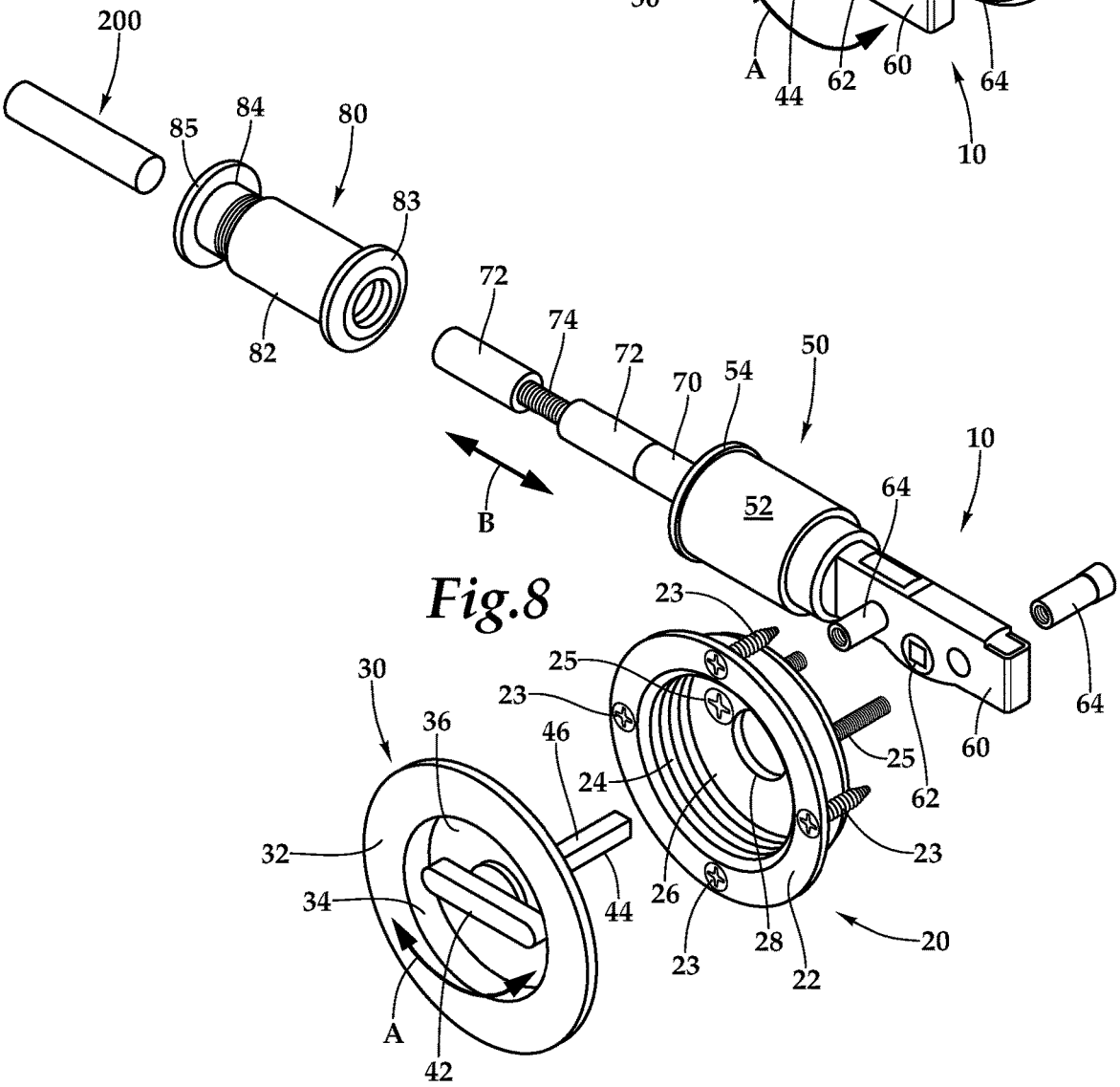
FIG. 8 is a front partially exploded perspective view of that which is shown in FIG. 5.
Figure 9:
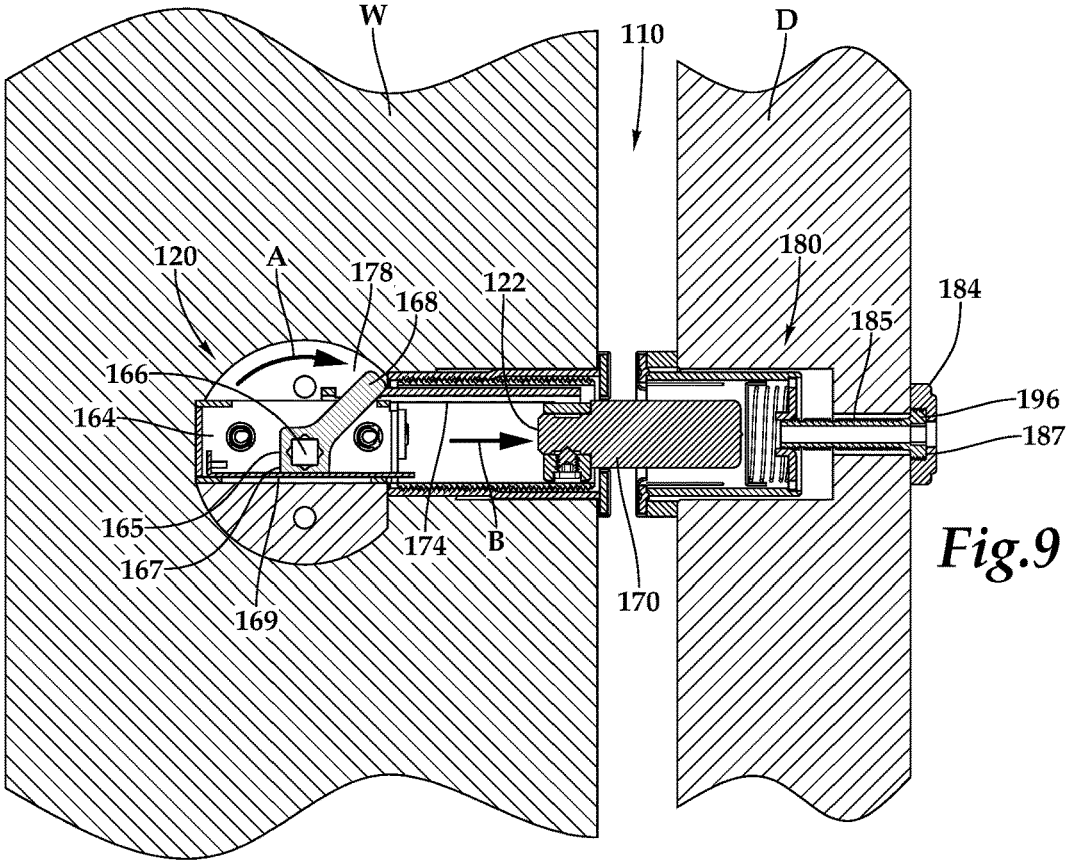
FIG. 9 is a front elevation sectional view of the lockset and strike of this invention according to a second embodiment, shown mounted within a doorway jamb and barn door, and with portions of the doorway jamb, barn door and lockset cutaway to reveal interior details when a bolt of the lockset has been translated into its deployed position, locking the barn door.
Figure 10:
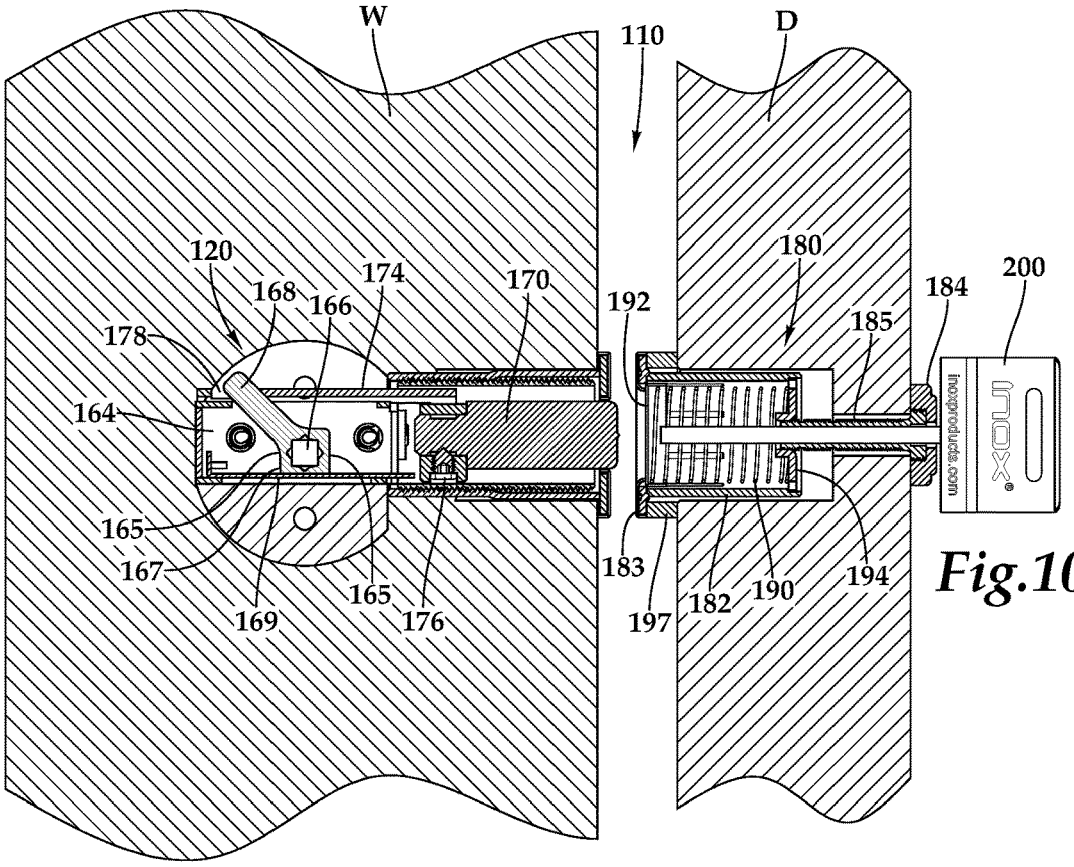
FIG. 10 is a front elevation sectional view similar to that which is shown in FIG. 9, but with the both of the lockset shown in its retracted position, unlocking the barn door.
Figures 11, 12, 13:
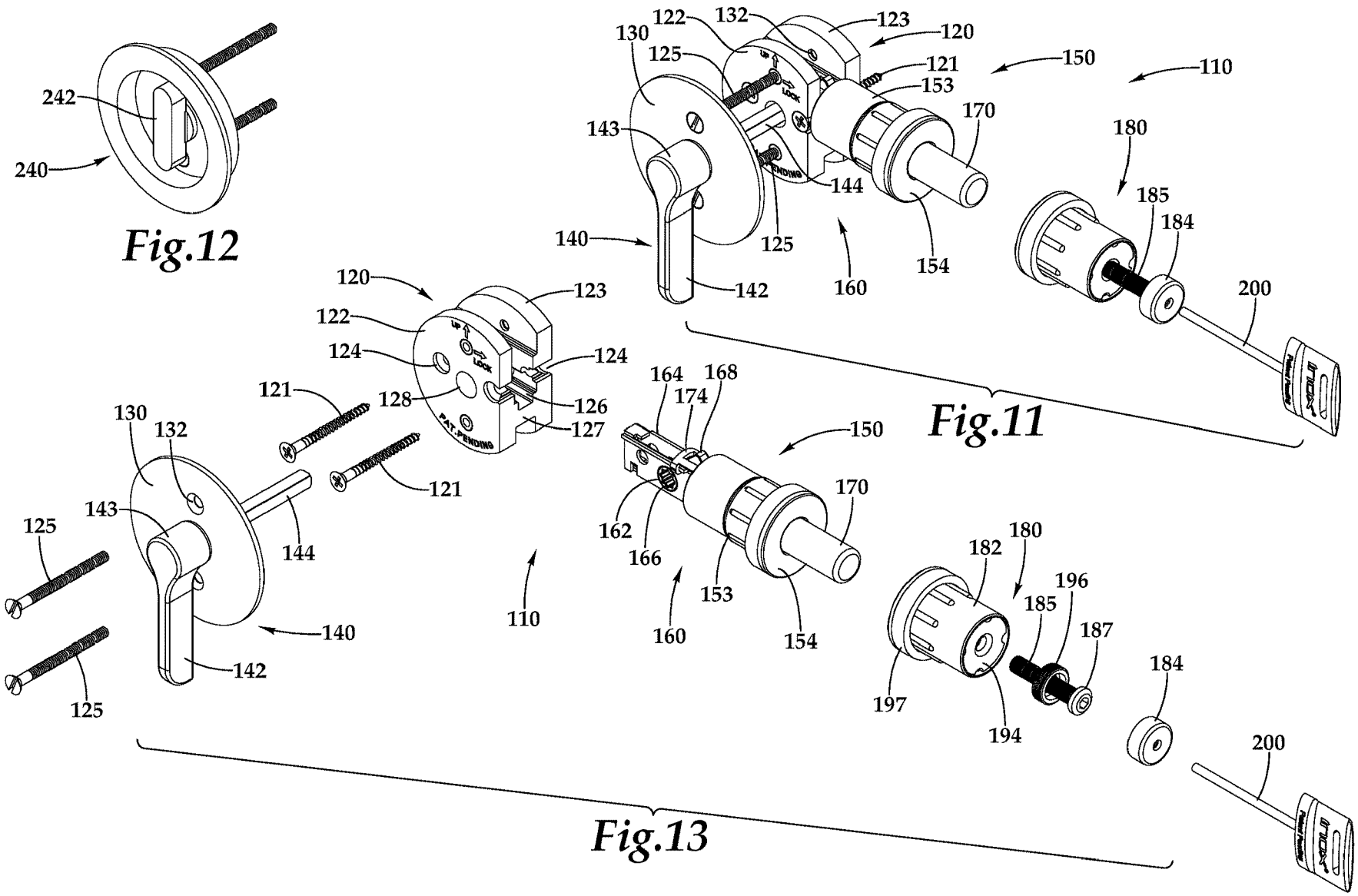
FIG. 11 is an assembled perspective view of the lockset of FIG. 9 along with the associated strike and emergency release key.
FIG. 12 is a perspective view of at alternative cover plate with a recessed handle for substitution with a disabled accessible handle shown in FIG. 11.
FIG. 13 is a perspective exploded parts view of that which is shown in FIG. 11.
Figures 14, 15, 16, 17:
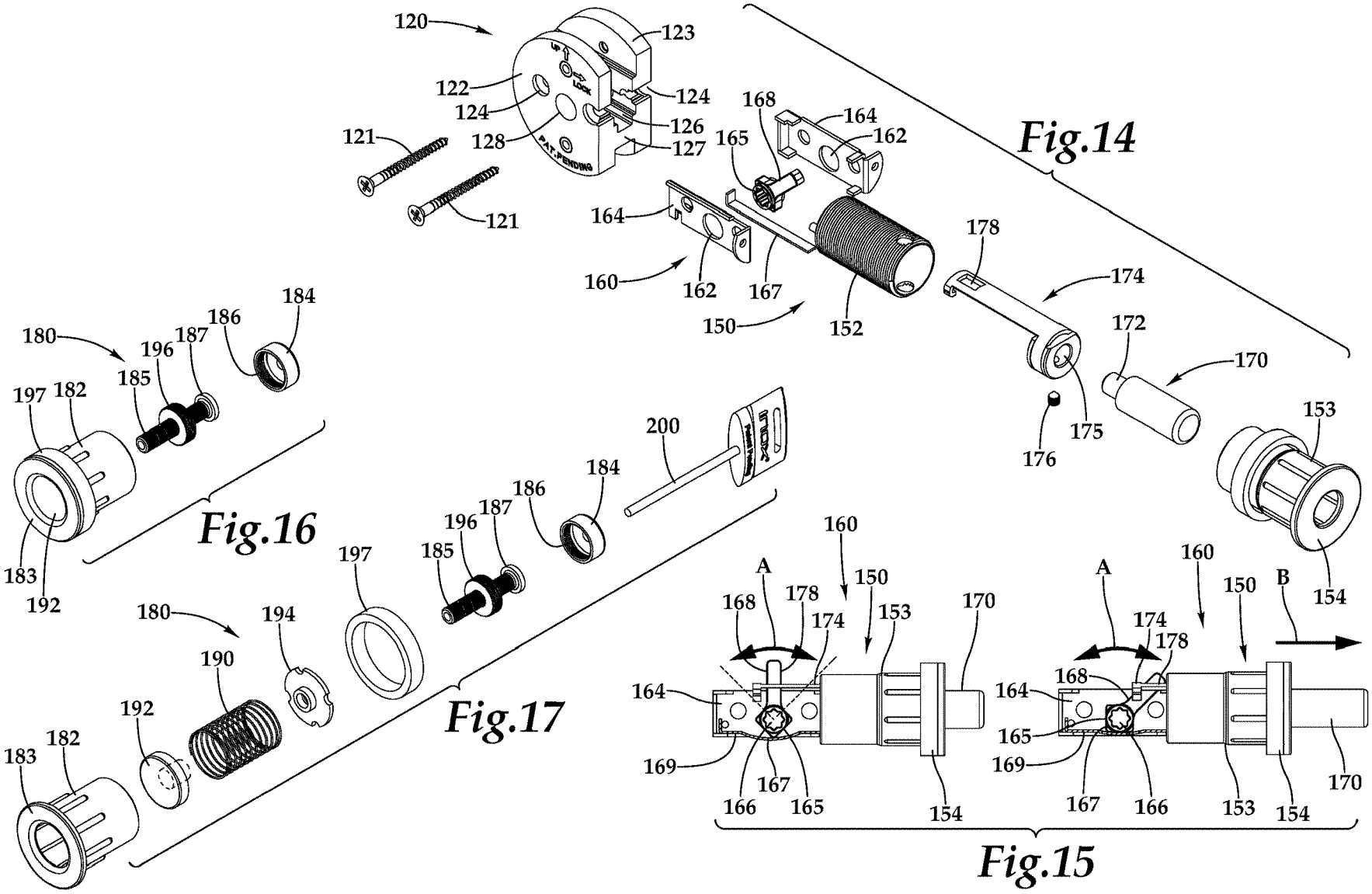
FIG. 14 is a perspective exploded parts view of a lockcase portion of the lock as shown in FIG. 13.
FIG. 15 is a front elevation view of that which is shown in FIG. 9, with the bolt shown at least partially extended from its retracted position and into its deployed position.
FIG. 16 is a perspective view of the strike according to the embodiment of FIG. 9.
FIG. 17 is a perspective exploded parts view of that which is shown in FIG. 16.

In essence, and with particular reference to FIGS. 7 and 8, basic details of the lockset 10 are described, according to a first embodiment. The lockset 10 includes a lockcase 50 which supports a bolt 70 in a manner allowing the bolt 70 to translate relative to a body 60 of the lockcase 50 (along arrow B) between a retracted position and a deployed position. The lockcase 50 is mounted into a face F of a jamb J adjacent to a doorway passage P (FIGS. 1-3, 4 and 6), that is selectively opened/closed by the barn door D. The lockcase 50 is oriented so that the bolt 70 translates through and away from an exterior E of the jamb J.

A handle 40 is coupled to the lockcase 50, so that when the handle 40 is actuated, such as by rotation (along arrow A of FIGS. 7 and 8), the lockcase 50 causes the bolt 70 to translate. In this embodiment, a base plate 20 and cover plate 30 are mounted into the face F of the jamb J, supporting the handle 40 and securing the lockcase 50 within an interior of the jamb J precisely where desired (and to preferably conceal screws used to mount the handle assembly and lockcase 50).

A strike 80 is also preferably provided as part of the system of this invention for use with the lockset 10. The strike 80 provides, at a minimum, a hole passing into the barn door D at an appropriate location so that when the bolt 70 moves to its deployed orientation it extends into the strike 80. The strike 80 most preferably passes entirely through the barn door D and includes an outer entry through which a key 200 or other structure can be placed to push back the bolt 70 away from its deployed orientation and out of the strike 80, and so that emergency access can be gained through the barn door D in the doorway passage P.

More specifically, and with particular reference to FIGS. 1-8, particular details of the lockset 10 and related privacy lock system are described, according to this first embodiment. In this embodiment, a base plate 20 and cover plate 30 are provided separate from each other. However, it is conceivable that a single plate could be provided which merges some or all of the features of the base plate 20 and cover plate 30. It is also conceivable that the lockcase 50 could be held in place within the jamb J without requiring any base plate 20 or cover plate 30. In this preferred embodiment, the base plate 20 acts to secure the lockcase 50 and other portions of the lockset 10 in the desired position within a recess formed into the jamb J and inboard of the face E The cover plate 30 attaches to the base plate 20 and provides a clean outer appearance surrounding the handle 40.

The base plate 20 is preferably a rigid monolithic structure, typically formed of a machinable metal, but conceivably formable from casting or injection molded (such as from plastic), or formed of wood, metal or other materials, either molded or machined or otherwise formed. The base plate 20 includes a flange 22 which preferably resides adjacent to the face F and in a plane parallel with a longest dimension of the lockcase of the jamb J. The flange 22 preferably includes holes which receive frame screws 23 which pass through the holes in the flange 22 and then embed into material of the face F of the jamb J adjacent to the recess into which the lockset 10 is placed.

The base plate 20 includes a collar 24 extending inwardly from the flange 22 to a floor 26. The floor 26 is preferably planar in form and parallel with the flange end perpendicular to the collar. Mount screws 25 pass through holes in the floor 26 and thread into standoffs 27 or other portions of the lockcase 50 to secure the base plate 20 to the lockcase 50. Thus, the base plate 20 is held in position relative to the jamb J by the frame screws 23 and the base plate 20 holds the lockcase 50 to the base plate 20 through the mount screws 25.

Preferably standoffs are provided associated with these mount holes so that the mount screws can either thread into the standoffs rather than into the mount holes directly, or the standoffs can merely act as alignment structures with the mount screws sufficiently long that they pass through the standoffs and into the mount holes of the lockcase for threadable attachment. In one embodiment, the standoffs are two part standoffs with a central cylinder and an outer cylinder for each of the standoffs. The central cylinders have a smaller diameter and are pressfit into the body and extending perpendicularly away from the body and toward the base plate. The outer cylinder standoff portions fit over the central cylinder standoff portions for alignment of the base plate with the body. Then, the mount screws pass through or into the standoffs and threadably attach the base plate securely to the body of the lockcase. In embodiments shown, the standoffs are female threaded elongate cylindrical structures held to the body by fastening to the body or by action of the mount screws passing through the floor of the base plate and into the standoffs, so that the standoffs are configured as she bolts.

A hole 28 is formed in the center of the floor 26 which allows portions of the handle 40 to pass through the base plate 20 and engage with a lock mechanism within the lockcase 54, for actuation of the lockset 10 and movement of the bolt 70 between its retracted orientation and its deployed orientation. The collar 24 is a cylindrical ring shaped structure defining a depth by which the floor 26 is spaced from the flange 22, with the floor 26 preferably parallel with the flange 22. The collar 24 in this embodiment also includes female threads thereon which allow for attachment of the cover plate 30 (described below) to the base plate 20 without requiring separate fasteners. However, the cover plate 30 could be attached to the base plate 20 by other means, or the cover plate 30 could be dispensed with entirely.

In this embodiment, the cover plate 30 includes an annular shoulder 32 which overlies the flange 22 of the base plate 20. Inboard of the shoulder 32, a ring 34 extends cylindrically and generally perpendicular to the shoulder 32. A shroud 36 surface is located on an inboard end of the ring 34 opposite the shoulder 32, with the shroud 36 preferably parallel with the shoulder 32. An outer surface of the ring 34 preferably includes male threads thereon which match the female threads on the collar 24. Thus, the ring 30 can thread into the collar 24 so the cover plate 30 attaches to the base plate 20. A hole passes through a center of the shroud 36 of the cover plate 30, which is aligned with the hole 28 in the base plate 20 and facilitates portions of the handle 40 passing through the cover plate 30 for engagement with the lock mechanism within the lockcase 50 and for actuation of the bolt 70.

Figure 2:
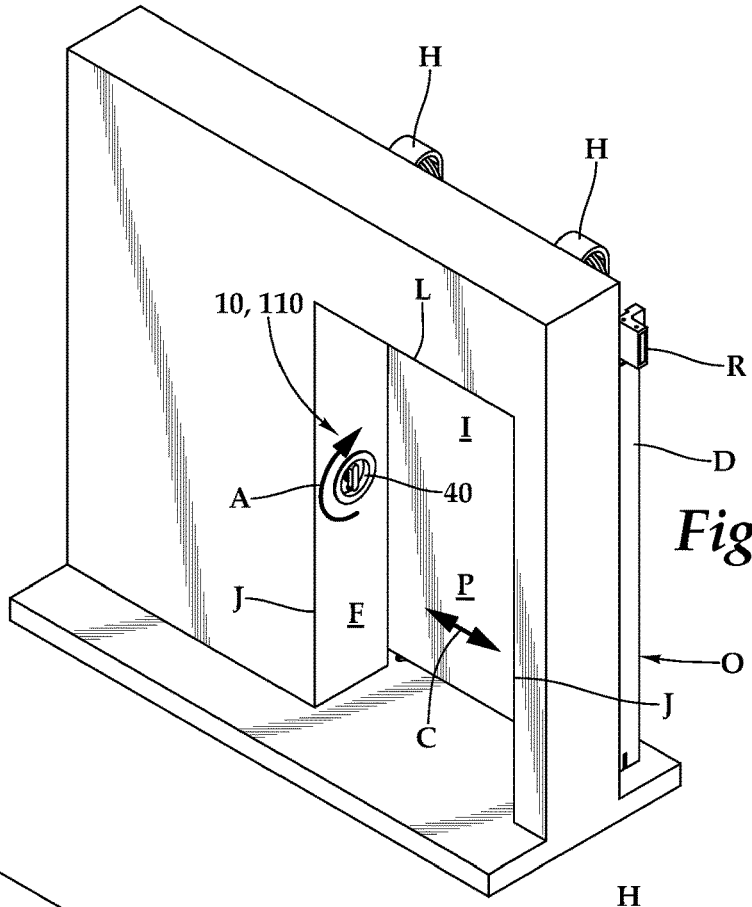
FIG. 2 is a perspective view of that which is shown in FIG. 1 from an interior of the doorway, and showing a privacy door lock with a recessed handle according to one embodiment of this invention.
Figure 3:
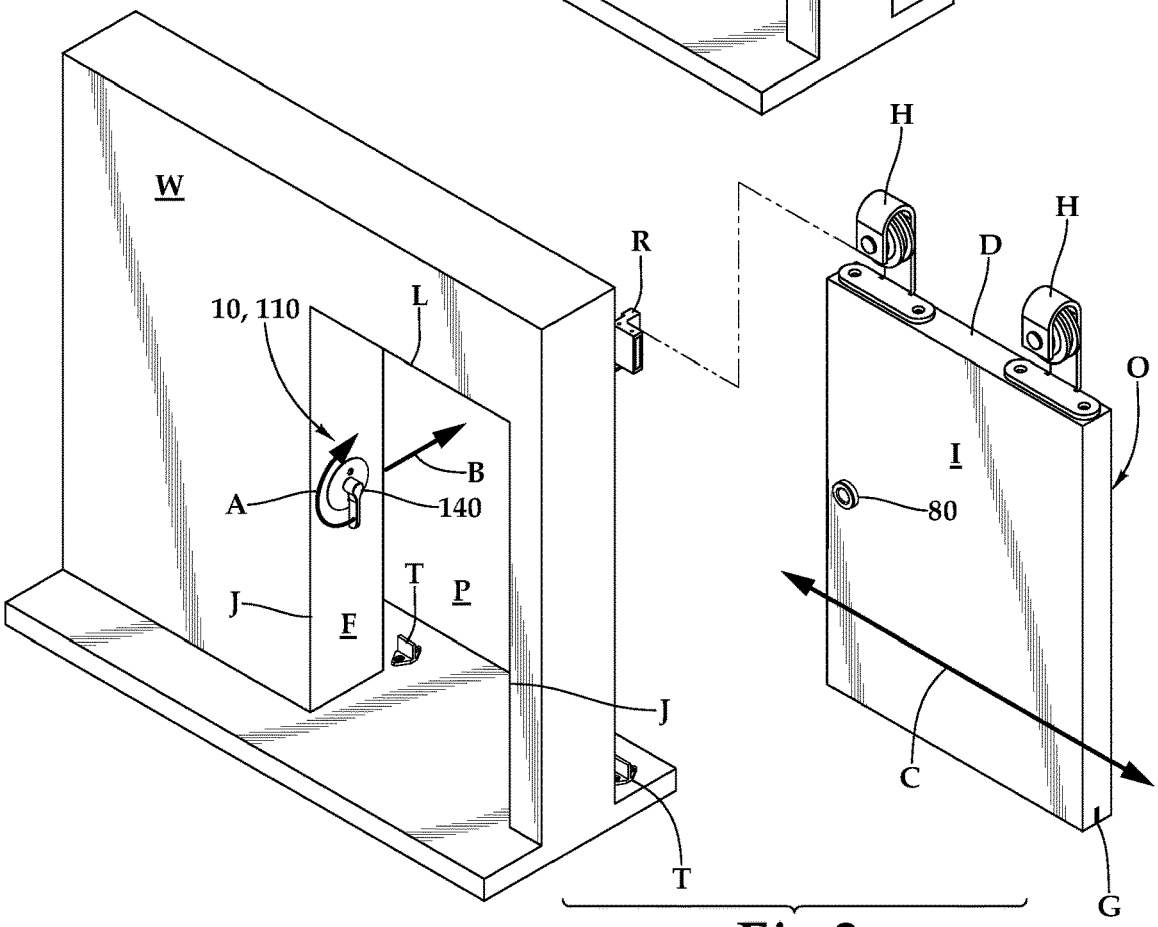
FIG. 3 is a perspective view of that which is shown in FIG. 1 from an interior of the doorway, with the door shown exploded away, and showing a privacy door lock with a disabled accessible handle according to one embodiment of this invention.

In this embodiment, the handle 40 is configured to be a recessed handle. In other embodiments this recessed handle 40 is replaced with a handle 140 (FIGS. 1, 3, 11 and 13) which is disabled accessible but extends somewhat into the doorway passage P in the wall W which is selectively covered by the barn door D (FIGS. 1-3). The handle 40 includes a lever 42 which acts as a preferred form of user engaging portion for the handle 40. This lever 42 is fixed to a shaft 44. The lever 42 is preferably linear and elongate and oriented perpendicular to the shaft 44, with the shaft 44 joined to a midpoint of the lever 42. The lever 42 is sufficiently low profile that it is recessed at least partially (and preferably entirely) within the ring 34 of the cover plate 30, inboard of the shoulder 32. In this way, nothing can easily catch up on the handle 40 when one is walking through the doorway passage P, past the face F jamb J.

The shaft 44 is preferably linear and extends along a rotational axis centerline. The shaft 44 preferably includes facets 46 thereon which can assist in having the shaft 44 of the handle 40 engage with a lock mechanism within the lockcase 50. Alternatively, the shaft 44 can be otherwise affixed to structures within the lockcase 50. In this preferred embodiment, the shaft has a square cross-section with four flat faceted sides making up the facets 46. While the handle 40 of this preferred embodiment is shown as a rotating handle which causes the shaft 44 to rotate, it is conceivable that the handle 40 could be replaced with a slide handle which would merely be slid (such as toward or away from the barn door D), and with such a slide handle having a shaft which does not rotate, but rather a shaft that translates linearly (at least somewhat) and with a portion of such a translating shaft most distant from such a sliding handle engaging with the bolt 70 to move the bolt 70 between its retracted and deployed orientations.

Figure 4:
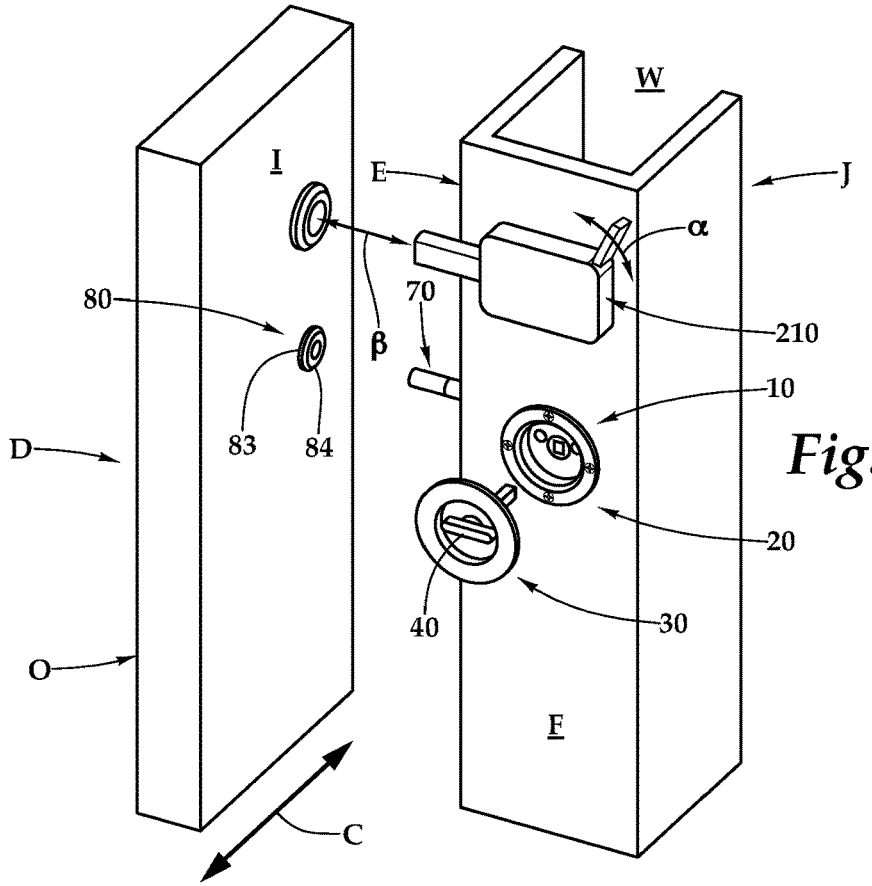
FIG. 4 is a perspective view of the lockset of this invention according to a first embodiment and with a cover plate and handle exploded from a base plate thereof, and showing how the lockset and strike are positioned within a face of one of the jambs of the doorway passage and with a strike thereof mounted within the barn door. This figure also shows an alternative surface mounted barn door privacy lock according to an alternative embodiment shown in detail in FIGS. 18-23.
Figure 5:
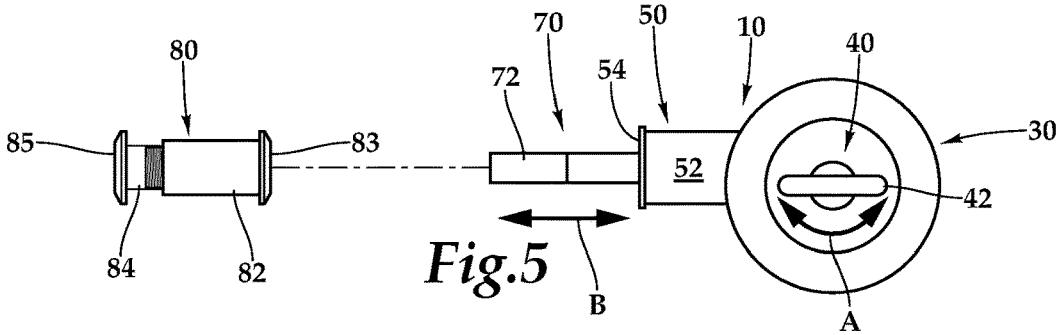
FIG. 5 is a front elevation view of the lockset and strike of FIG. 4.
Figure 6:
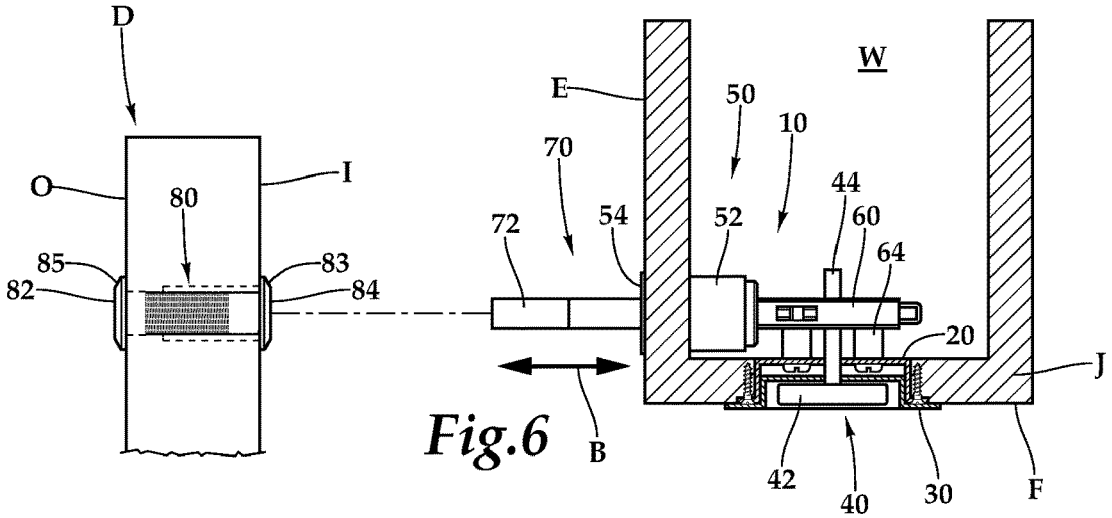
FIG. 6 is a top plan view of the lockset and strike of FIG. 4, and shown mounted within the doorway jamb and barn door, and with the barn door exploded away from the jamb.

With particular reference to FIGS. 3-5, details of the lockcase 50 are described, according to this first embodiment. The lockcase 50 acts as a lock mechanism between the handle 40 and the bolt 70 to cause the bolt 70 to move between its retracted orientation and its deployed orientation under action of the handle 40. Because the shaft 44 of the handle 40 is not parallel with the elongate bolt 70, the lockcase 50 needs to transfer action between the handle 40 and the bold 70 about an angle (typically 90°).

The lockcase 50 can have any of a variety of interior configurations to cause rotating motion of the shaft 44 of the handle 40 (arrow A of FIGS. 5, 7 and 8) to be converted into translating linear motion of the bolt 70 (arrow B of FIGS. 5-8). One particular embodiment of such a lockcase 50 is disclosed in detail hereinbelow with respect to a second embodiment alternate lockset 110 (FIGS. 9-17). The lock mechanism for transmitting rotating shaft 44 motion into translating bolt 70 motion, according to this first embodiment (FIGS. 1-8) would be to include a spur gear on a distal end of the shaft 44 and to include a rack gear on a proximal end of the bolt 70. The spur gear and rack gear would be enmeshed together, so that when the shaft 44 rotates (about arrow A), the spur gear also rotates and causes translation of the rack gear, which in turn causes the bolt 70 to translate (along arrow B). Other lock mechanisms could be similar to those of the second embodiment (FIGS. 9-17) described in detail below.

The bolt 70 is a rigid structure of hard material, typically steel, which is caused to translate linearly from a deployed orientation to a retracted orientation, and vice versa, by action of the lock mechanism within the lockcase 50, which is actuated by the handle 40. The bolt 70 can include an optional extension 72 with a threaded post 74 which threads into a threaded hole at an end of the bolt 70 (or vice versa). Such an extension 72 can be added if needed to accommodate thicker jambs J with a greater distance to an exterior E of the jamb J. Similarly, the extension 72 on the bolt 70 can be provided if a larger than typical gap exists between the barn door D and the wall W. The extensions can be rotated to provide adjustable bolt length as well. The bolt 70 could have any of a variety of different cross-sectional shapes. In this embodiment, the bolt is shown with a circular cross-section and a cylindrical form having a constant cross-section along its length. Such a contour for the bolt 70 allows it to easily pass into a cylindrical central bore within the strike 80.

The strike 80 could in a simplest form of the invention merely be a hole formed in the barn door D. Most typically, this hole would be cylindrical and having a circular cross-section, similar to a size of the bolt 70, but typically slightly larger so that alignment of this hole with the bolt 70 can be accommodated. Most preferably, the strike 80 is provided as a hardened structure which supplies this hole for the bolt 70. The strike 80 at a minimum is a bore extending into an inside of the barn door D. Most preferably this bore passes entirely through the barn door D and out to the outside of the barn door D, so that the bore is in the form of a through bore. In the most preferred embodiment for this strike 80, an outer sleeve 82 and inner sleeve 84 are provided which threadably attach together and define this through bore passing through the barn door D when the sleeves 82, 83 are attached together. Lips 83, 85 on the sleeves 82, 84 act as stops which abut the outside O and inside I of the barn door D after the sleeves 82, 84 have been fully threaded together. In one embodiment, these sleeves 82, 84 have a substantially constant circular cross-section, but can be tapered slightly near the lips 83, 85, and in particular adjacent to the lip 85 on the inner sleeve 84. Such a taper can cause a diameter of the door to be slightly greater at the lip 85, and help to align the bolt 70 with the strike 80, especially if the strike 80 is slightly out of alignment with the bolt 70. In one embodiment, the through bore is not circular cross-section but is taller than it is wide, so that the strike 80 can be more easily placed without requiring precise vertical positioning relative to the bolt 70, but still providing a tight lock on the bolt 70 in its deployed orientation extending into the strike 80 (to resist door opening motion, such as along arrow C of FIGS. 1-4).

With particular reference to FIGS. 9-17, details of an alternative lockset 110 according to a second embodiment of this invention are described. The alternative lockset 110 is similar to the lockset 10 described above, except where specifically distinctly described herein. Also, the lockset 110 acts as a privacy door lock mounted at a similar position within a face F of a jamb J of a doorway passage P at a wall W, which is selectively opened/closed by a barn door D (by motion/sliding, along arrow C (FIGS. 1-3)).

While the barn door D could be carried in a variety of different ways, most typically hangers H (FIGS. 1-3) ride on a rail R above the doorway passage P, with the barn door D suspended from these hangers H. A series of tracks T (or a continuous track) are placed on the floor, in a preferred embodiment, which ride within a groove G in a lower surface of the barn door D, so the barn door D remains parallel with the wall W. The barn door D could be opened either to the left or to the right relative to an exterior of the doorway passage P (see both options together in FIG. 1, while typically only one or the other barn door D would be provided and the rail R correspondingly shortened).

Typically the barn door D is on an exterior of a room where privacy is desired and outside of where the handle 140 (for the privacy lock associated with the lockset 110) is located. Typically, a basic pull is attached to the barn door D (on the inside I, outside O or both), so that the barn door D can be most easily slid upon the rail R (along arrow C of FIGS. 1-4). The lockset 110 can be provided on either a left or right jamb J (viewing the doorway passage P from the outside of the room in which security is desired), and the lockset 110 can engage a strike 80 in the barn door D which is either adjacent to a leading edge or a trailing edge of the barn door D, depending on whether the lockset 110 is mounted into the left jamb J or right jamb J.

A bracket 120 (FIGS. 9-11, 13 and 14) is provided (in place of the base plate 20) which supports a lockcase 150 within a recess inboard of the face F of the jamb J. The bracket 120 preferably includes frame screws 121 which pass through frame holes 124 and secure the bracket 120 in position within this recess. The bracket 120 includes a front wall 122 and rear wall 123 which preferably have a perimeter shape matching that of the recess (e.g. circular/cylindrical), so that the bracket 120 is further held tightly in position. Most preferably, these walls 122, 23 are circular in form so that the recess can be formed by drilling a circular hole into the face F of the jamb J where the lockset 110 is to be accessed by a user.

Mount bores receive mount screws 125 which also pass through mount holes 132 in an annular cover plate 130 to allow the annular cover plate 130 to be securely attached to the bracket 120. A slot 126 is provided between the front wall 122 and rear wall 123 of the bracket 120. This slot 126 is sized to receive a lockcase 150 therein extending in a lateral direction generally perpendicular to surfaces of the front wall 122 and rear wall 123, so that the lockcase 150 can be securely held relative to the bracket 120. The bracket 120 would typically be placed into the recess in the jamb J by passing through the face F of the jamb J, while the lockcase 150 would extend through the exterior E (FIGS. 1, 4 and 6) of the jamb J in a direction extending generally parallel with the face F and inserted into the slot 126 in the bracket 120. A web 127 spans the slot 126 and joins the front wall 122 to the rear wall 123 so that the bracket 120 is a single rigid construction. A hole 128 passes through the front wall 122 and accommodates a shaft 144 of the handle 140 passing through the front wall 122 of the bracket 120 and to a location in the slot 126 where the shaft 144 can access a lock mechanism within the lockcase 150.

The annular cover plate 130 is similar in many respects to the cover plate 30, and with screw holes 132 passing therethrough which allows the mount screws 125 to pass through the screw holes 132 and then into the mount screws 125 for the bracket 120. The mount screws 125 can be tightened to removably secure the cover plate 130 to the bracket 120. The cover plate 130 is preferably substantially flat and facilitates a handle 140 which is disabled accessible (or, as an alternative, a recessed handle 240 (FIG. 12) can be provided similar to the handle 40 (FIGS. 4-8) including a lever 242). The handle 140 includes a lever 142 extending from an outer hub 143. The shaft 144 extends perpendicularly away from the lever 142 at the hub 143 and sufficiently to pass into the lockcase 150 for engagement of a lock mechanism, in a manner causing the bolt 170 to translate (arrow B of FIGS. 9 and 15) relative to the lockcase 150 when the handle 140 rotates (along arrow A of FIGS. 9 and 15).

The lockcase 150 preferably includes a body 160 which contains at least portions of the lockcase 150 therein. The bolt 170 portion of the lockset 110 is preferably contained within a barrel core 152 and barrel cover 153 which also form portions of the lockcase 150. The body 160 includes port 162 which can receive the shaft 145 of the handle 140 passing into an interior of the lockcase 150. A pair of housing plates 164 on opposite sides of the body 160 encapsulate the lock mechanism within the lockcase 150 with the port 160 passing into (or through) the housing plates 164.

In this particular embodiment of the lock mechanism of the lockcase 150, a hub 165 is located within the body 160 and adjacent to the port 162 which has a bore 166 passing therethrough (or just thereinto) which can receive the shaft 144 of the handle 140 therein. This bore 166 has facets which accommodate facets on the shaft 144 so that when the handle 140 rotates, the hub 165 is caused to rotate along with the shaft 144 and handle 140 (along arrow A).

The hub 165 preferably has a cam surface 167 on outer portions thereof. This cam surface 167 interacts with a leaf spring 169 adjacent to the hub 165, so that when prominences on the cam surface 167 pass the spring 169, some resistance to hub 165 rotation is encountered, and when low portions of the cam surface 167 are adjacent to the spring 169, little or no resistance to hub 165 rotation is encountered.

Furthermore, the hub 165 includes a finger 168 extending radially therefrom. The finger 168 passes through a pocket 178 in an arm 174 which is coupled to the bolt 170. When the hub 165 rotates, the finger 168 also rotates (arrow A) and, residing within this pocket 178, causes the arm 174 to translate (arrow B), and to translate the bolt 170 linearly along a central axis of the bolt 170. A proximal tip 172 of the bolt 170 preferably is recessed in size and resides within a seat 175 in a distal end of the arm 174. A setscrew 176 joins the proximal tip 172 of the bolt 170 to the arm 174. Bolts 170 having different lengths can be selected so that the bolt 170 travel distance is in an amount desired. Alternatively, or in addition, the barrel core 152 and barrel cover 153 can be threadably attached together at various different positions amounts to alter a length of the combined barrel core 152 and barrel cover 153 and to further allow for adjusting of the position of the bolt 170. An annular flange on the barrel cover 153 typically resides against the exterior E of the jamb J and helps to securely hold the lockcase 150 and associated bolt 170 precisely and solidly where desired.

Most preferably in this embodiment, strike assembly 180 is provided within the barn door D for receipt of the bolt 170 when it is in its deployed orientation. The strike assembly 180 includes a hollow cylinder 182 with an annular flare 183 on an inner portion thereof adjacent to an inside I of a barn door D (or spaced away by a spacer 197). An outer cap 184 preferably attaches to the cylinder 182 (through intermediate structures) and is adjacent to the outside O of the barn door D. A shaft 185 preferably threadably attaches to the outer cap 184 through threads on a head 187 or nut 196 of the shaft 185 which cooperate with threads on an interior of the outer cap 184 to hold the head 187 to the cap. A spring 190 is interposed between a dust cap 192 and a base 194 (to which the shaft 185 can threadably attach in a central collared hole therein), with the base 194 adjacent to the shaft 185 and the dust cap 192 adjacent to the barrel core 152 and barrel cover 153 of the lockcase 150. Spring 190 causes the dust cap 192 to close off the cylinder 182 within the strike assembly 180. However, when the bolt 170 strikes the dust cap 192, the spring 190 is compressed and the bolt 170 is allowed to pass into the cylinder 182. A key 200 or other elongate structure can pass into the shaft through the outer cap 184 and pass through a central hole in the bolt 185 and abut against the dust cap 192 to push the bolt 170 from its deployed orientation back toward its retracted orientation, such as for emergency access through the doorway passage P after the door D has been opened by sliding (along arrow C).

With particular reference to FIGS. 18-23, details of an alternative embodiment surface mounted lock set 210 are described. This alternative lock set 210 is also shown in FIG. 4 as an alternative to the lock set 10 described above. In essence, and with particular reference to FIG. 20, basic details of the alternative lock set 210 are described. The lock set 210 includes a lockcase 250 which is mountable to a jamb J of a doorway F in a wall E, which is selectively closed by a barn door Q. The lockcase 250 includes a base plate 220 on one side thereof which is fastened to the jamb J, such as through jamb screws 222 or other wood screws, or other fasteners. A cover 230 attaches to the base plate 220 and contains a mechanism which converts manual actuation of the lock set 210 into a locking and unlocking action of the lock set 210. This mechanism includes a lever 240 which is actuated by handle to 242.

A shuttle 260 interacts with the lever 240 so that when the lever 240 is moved, the shuttle 260 is also moved. A bolt 270 is connected to the shuttle 260, with the bolt 270 moving between a retracted position more fully contained within the lockcase 250, and a deployed position extending out of the lockcase 250 and at least partially into a strike 280 in the barn door Q. This strike 280 can be similar to the strike 80 described in detail above, except that a size and shape of a hollow core thereof can be modified to receive a uniquely shaped bolt 270 disclosed in this embodiment.

Figure 20:
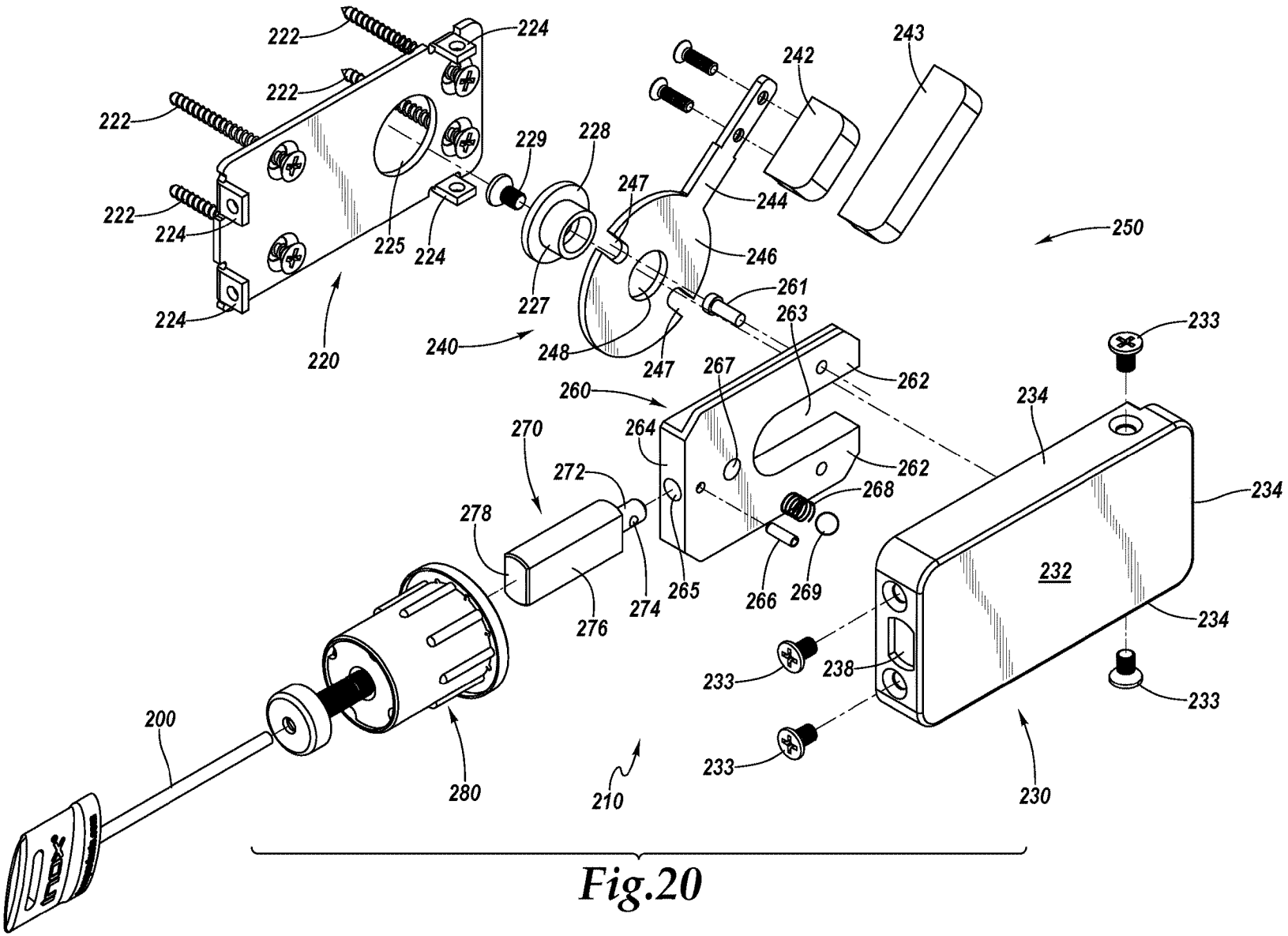
FIG. 20 is an exploded perspective view of that which is shown in FIG. 18, but from a reverse perspective, and also showing a base plate of the lock which is mountable to a jamb of a doorway for surface mounting of the lockcase on a surface of the jamb.

More specifically, and with particular reference to FIG. 20, details of the base plate 220 are described, according to one embodiment of this surface mounted lock set 210. The base plate 220 is a rigid planar structure with a series of holes therein which can receive wood screws or other jamb screws 222 passing therethrough. Heads of these jamb screws 222 remain on one side of the base plate 220 while threads on a shaft of the jamb screws embed into the jamb J. Preferably four such jamb screws 222 are provided through four holes located close to corners of the base plate 220. While screws 222 provide a preferred form of fastener for holding the base plate 220 to the jamb J, other fasteners could alternatively be utilized, including adhesive, or mechanical fasteners. The base plate 220 is preferably rectangular in form with a similar perimeter size to that of the overall lockcase 250.

The base plate 220 includes tabs 224 extending perpendicularly away from the base plate 220. These tabs 224 which include holes therein, can receive screws 233 which hold the cover 230 to the base plate 220 through the tabs 224. These tabs 224 are preferably located near corners of the base plate 220, with two of the tabs 224 oriented within a vertical plane and two of the tabs 224 oriented in parallel and spaced horizontal planes. Holes in a perimeter skirt 234 of the cover 230 are strategically located to match locations of the tabs 224 so that screws 233 can pass through these holes in the perimeter skirt 234 of the cover 230 for holding of the cover 230 onto the base plate 220.

The base plate 220 also preferably includes a hub hole 225 which supports a hub 226 which assists in rotationally supporting the lever 240 within an interior of the lockcase 250. This hub 226 is shown in both FIG. 18 and FIG. 20, as well as somewhat within FIG. 19. The hub 226 is a rigid structure preferably provided separate from the base plate 220, but which could be formed with the base plate 220. The hub 226 can be configured to rotate relative to the base plate 220 or to be fixed relative to the base plate 220.

The hub 226 includes a boss 227 extending axially along a central axis of the hub 226 and having a circular cross-section and generally cylindrical form. A flange 228 is also provided on the hub 226 which is annular in form and sized to reside within the hub hole 225. A fastener 229 passes through a hole along a central axis of the hub 226 and allows for the hub 226 to be fastened to a standoff 235 extending from an interior side of a face 232 of the cover 230. This fastener 229 is a screw in this embodiment, with the standoff having a hole centrally located therein with female threads.

Figures 18, 19:
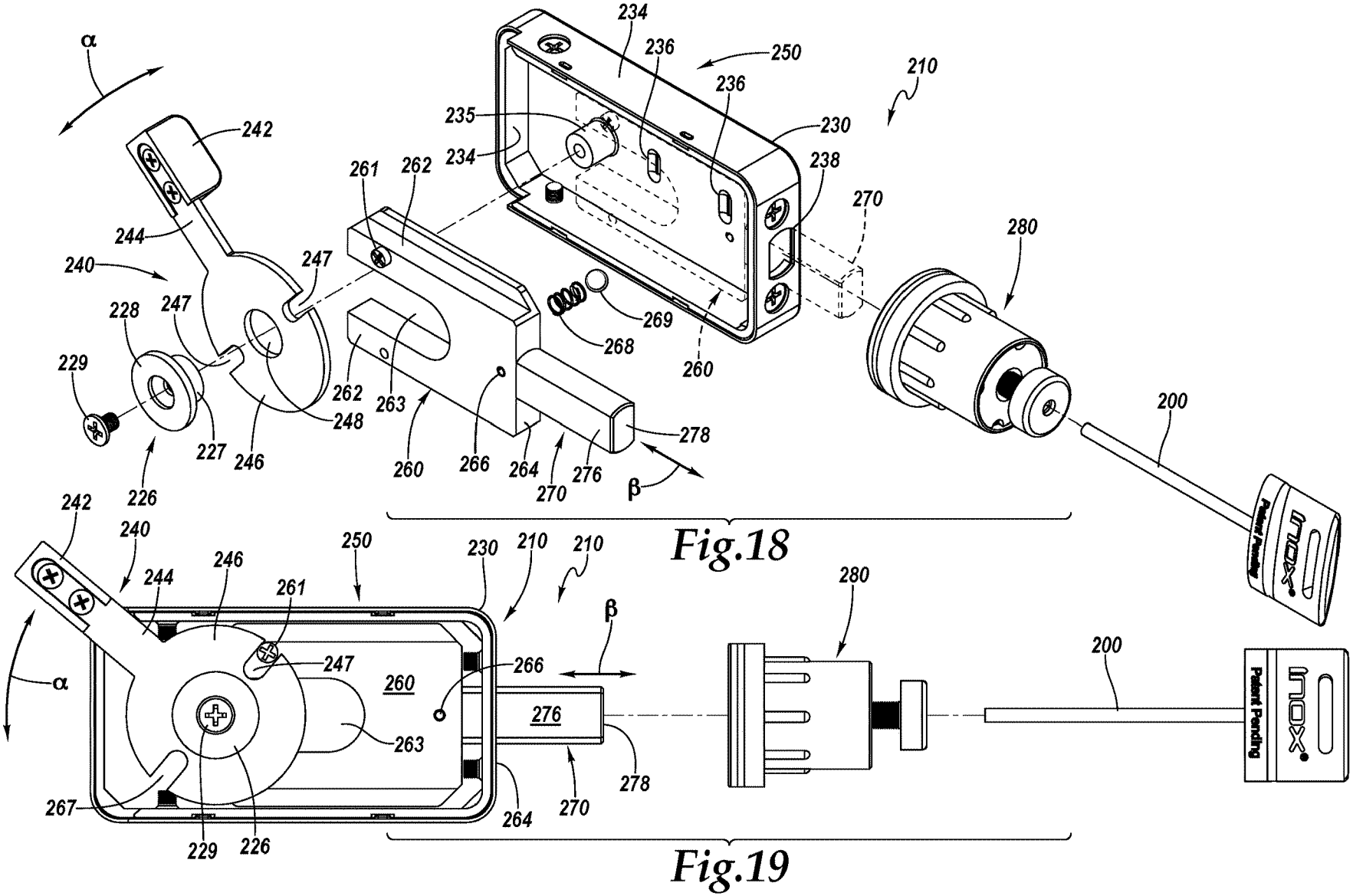
FIG. 18 is an exploded perspective view of a lock set according to an alternative embodiment and which is particularly suited for mounting to a surface of a jamb of a doorway.
FIG. 19 is a front elevation view of the lock set of FIG. 18 with a lockcase of the lock shown with a cover removed so that interior mechanism details are revealed.
Figure 21:
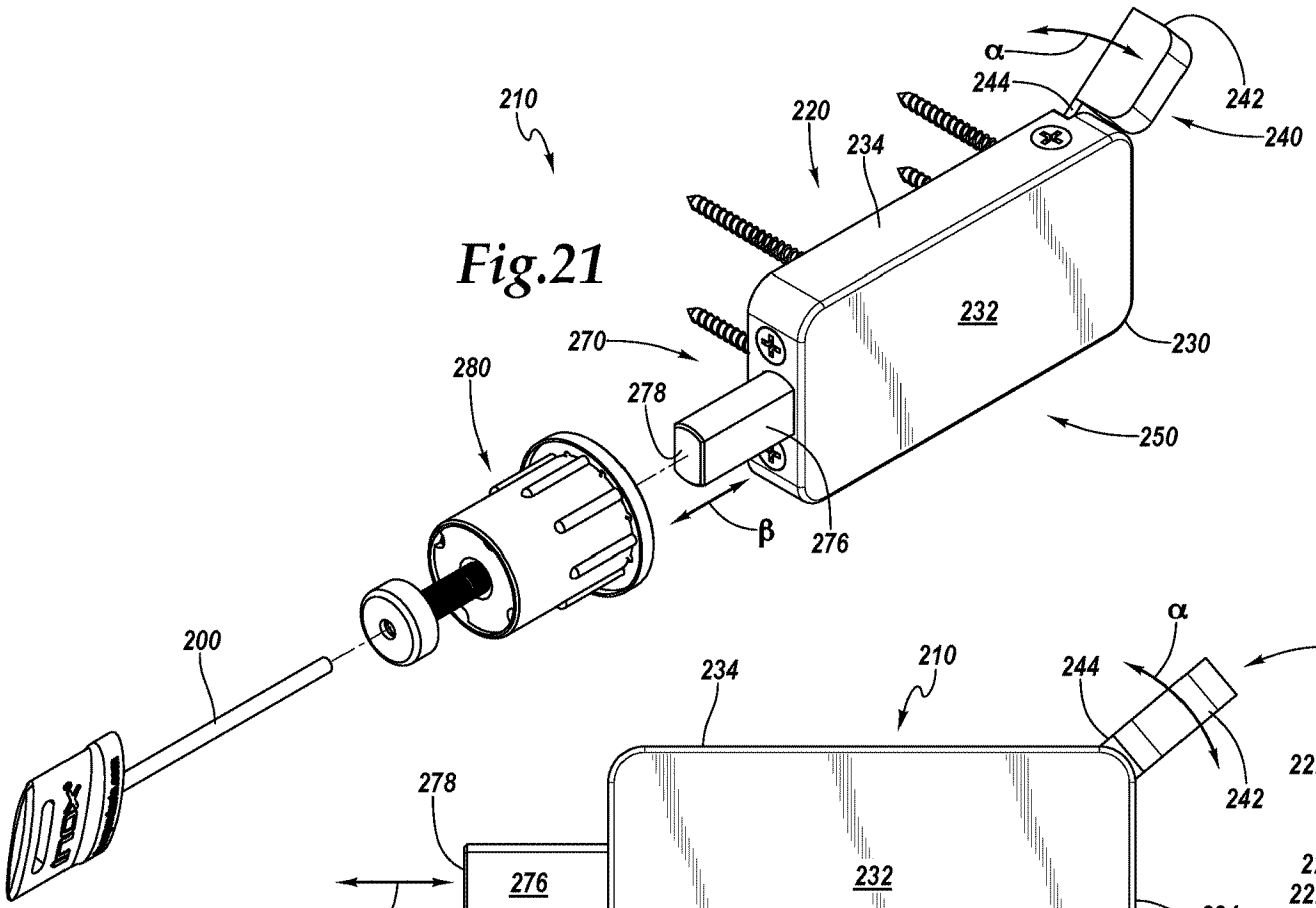
FIG. 21 is a perspective view of the lock of FIG. 18, with the lockcase and internal mechanisms shown assembled together and shown adjacent to a strike, and showing a key for unlocking the lock and exterior of the barn door.
Figure 22:
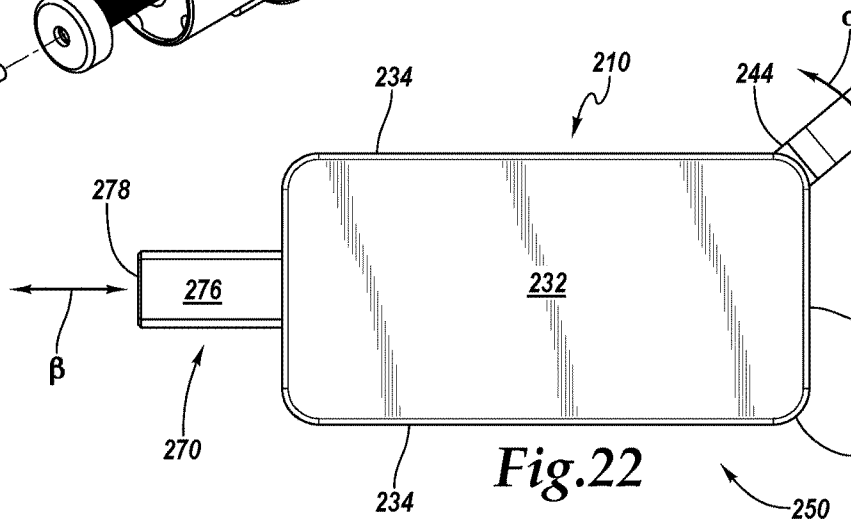
FIG. 22 is a front elevation view of the lockcase of FIG. 21.
Figure 23:
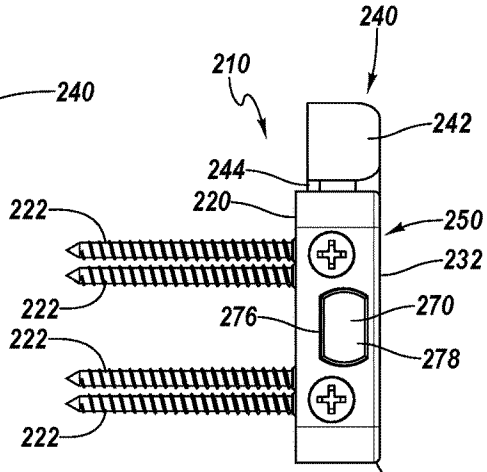
FIG. 23 is an end elevation view of that which is shown in FIG. 22.

With continuing reference to FIGS. 18 and 20, as well as FIGS. 21-23, details of the cover 230 are described. The cover 230 along with the base plate 220 provides an enclosure of the lockcase 250 to contain a mechanism which converts movement of a handle 242 of the lever 240 into movement of the bolt 270. The cover 230 is preferably a rigid monolithic structure fastenable to the base plate 220, such as through the screws 233 passing through holes in the perimeter skirt 234 of the cover 230 and then threading into the tabs 224 of the base plate 220. As an alternative, other forms of fasteners could hold the cover 230 to the base plate 220. The base plate 220 and associated portions of the lock set 210 could be on either the left or right side of the doorway, and on a jamb closer to a leading edge of the barn door or closer to a trailing edge of the barn door. Wherever the base plate 220 and associated portions of the lock set 210 are located, the strike 280 would be correspondingly placed so that when the strike 280 is aligned with the lock set 210, the barn door Q is in a closed position blocking the doorway F (see FIGS. 1-3).

The cover 230 preferably has a rectangular form for a face 232 thereof which is similar to an outline of the base plate 220. The perimeter skirt 234 extends perpendicularly away from a plane in which the face 232 is oriented, and extending toward the base plate 220. The cover 230 includes troughs 236 within an inner surface of the face 232 which interact with a detent structure on part of a mechanism associated with the bolt 270, so that the bolt 270 has a tendency to be biased toward remaining in either a retracted position or a deployed position for the bolt 270. The cover 230 also includes a port hole 238 in a portion of the perimeter skirt 234, which allows the bolt 270 to extend out of an interior of the lockcase 250 and toward the barn door Q, for selective locking thereof.

With particular reference to FIGS. 18-20, details of the lever 240, shuttle 260 and bolt 270, together comprising a mechanism within the lockcase 250, are described, according to this alternative embodiment. While the lever 240 could as an option be a translating structure, the lever 240 most preferably is a pivoting structure supported by the lockcase 250. In particular, the lever 40 includes a handle 242 at a distal end of an arm 244 extending from a wheel 246 adjacent to a rotational axis of the lever 240. The wheel 246 has a central hole 248 aligned with the hub 226 and with a central axis of the hub 226. The wheel 246 include slots 247 extending radially within the wheel 246, with at least one of the slots 246 interacting with a post 261 on the shuttle 260 to cause the post 261 and associated shuttle 260 to translate when the lever 240 rotates.

A distal tip of the arm 244 of the lever 240 can either include the handle 242 or a large handle 243. The large handle 243 can allow for disabled access, in that one with limited dexterity can still manually manipulate the large handle 243 to cause the lever 240 to rotate (along arrow α of FIGS. 18, 19, 21 and 22). The arm 244 extends radially away from the wheel 246 with the arm 244 and wheel 246 preferably either affixed to each other or formed from a monolithic rigid piece of material. The lever 240 is largely planar and thin, with the arm 244 extending out of a slit between the cover 230 and the base plate 220, so that the handles 242, 243 can be located outside of the lockcase 250 for manual access, while other portions of the lever 240 including most of the arm 244, remain inside the lockcase 250.

While the shuttle 260 could conceivably rotate, most preferably the shuttle 260 translates within the lockcase 250. The shuttle 260 is a rigid structure which preferably is formed having two horizontal extending fingers 262 adjacent to upper and lower portions of the lockcase 250, and with a gap 263 between the fingers 262. The gap 263 allows portions of the hub 226 to reside therein, and to help to keep the shuttle 260 translating horizontally linearly within the lockcase 250.

A post 261 extends laterally and horizontally from one of the fingers 262 and resides within one of the slots 247 in the wheel 246 of the lever 240. In the embodiment depicted, the post 261 extends from the upper finger 262, and the post 261 is engaged by an upper one of the slots 247 in the wheel 246. However, the post 261 and slots 247 could be adjusted so that the post 261 is in the lower one of the fingers 262 and engages with the lower one of the slots 247 within the wheel 246.

A prow 264 of the shuttle 260 joins the two fingers 262 together. This prow 264 includes a bore 265 extending horizontally thereinto, and which receives a neck 272 of the bolt 270 therein. A set pin 266 passes laterally through the shuttle 260 and intersects into the bore 265, with such a set pin 266 also residing within a side hole 274 in the neck 272 of the bolt 270, so that the set pin 266 can hold the neck 272 of the bolt 270 within the bore 265 in the prow 264 of the shuttle 260. As an alternative, the bolt 270 could be formed with the shuttle 260, or otherwise coupled to the shuttle 260.

The shuttle 260 has a lateral surface facing an inside of the face 232 of the cover 230 which includes a pit 267 extending thereinto. This pit 267 supports a compression spring 268 with a detent ball 269 on an end of the spring 268 opposite the pit 267. The spring 268 pushes the detent ball 267 against the inside of the face 232 of the cover 230. Two troughs 236 in the inside of the face 232 of the cover 230 are strategically positioned so that the detent ball 269 resides within one of the troughs either when the bolt 270 is in a retracted position or when the bolt 270 is in a deployed position. The detent ball 269 and spring 268 thus cause the bolt 270 to be biased toward remaining in either the retracted position or the deployed position, rather than any intermediate position. The lock set 210 would thus tend to maintain a selected position unless affirmative force is applied, such as through the handle 242, 243 of the lever 240, to cause the lever 240 to rotate (along arrow α), and then in turn causing the shuttle 260 to translate (along arrow β of FIGS. 18, 19, 21, 22).

The bolt 270 is a rigid structure which is preferably formed separate from the shuttle 260 but affixed to the shuttle 260, such as through the set pin 266 and side hole 274 in the neck 272 of the bolt 270. The bolt 270 could be circular in cross-section, with a generally cylindrical form, but is depicted herein with planar lateral surfaces 276 and with curving upper and lower surfaces between these lateral surfaces 276. The bolt 270 extends to a tip 278 which is preferably flat and extends most deeply into the strike 280 when the bolt 270 is in a deployed position.

The bolt 270 can be returned from a deployed position to a retracted position by placing of a key 200 through the strike 280 from an exterior side of the barn door Q, applying sufficient force to overcome resistance of the detent ball 269 and to cause the shuttle 260 to translate (along arrow β) and to in turn cause the lever 240 to pivot along arrow α. Thus, the lock set 210 acts as a privacy lock, in that the lock set 210 can be unlocked by simply placing the key 200 or any thin elongate structure through the exterior hole passing into the strike 280, to unlock the privacy door lock. The strike 280 can be modified to have a shape which can accommodate an alternate shape of the bolt 270.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A surface mountable barn door privacy lock, comprising in combination:

a lockcase mountable to a jamb of a doorway, the doorway being selectively closable by a barn door;

a bolt slideably movably supported by said lockcase in both a retracted position and a deployed position relative to said lockcase, where, when said lockcase and said bolt are mounted on the door iamb during operational use, said deployed position of said bolt extending further toward the barn door than said retracted position of said bolt;

a handle movably supported by the lockcase;

said handle coupled at least indirectly to said bolt, to move said bolt between said retracted position and said deployed position when said handle moves;

a strike configured to be located in the barn door, the strike configured to receive said bolt therein when said bolt is in said deployed position;

wherein said strike includes a housing configured to extend entirely through the barn door from a one side of the barn door to an opposite side of the barn door, where said housing has a hole accessible on the one side of the barn door opposite the doorway, the hole sized to receive a key therein to push back said bolt to unlock the barn door.

2. The privacy lock of claim 1 wherein said strike is a hole in the barn door sized large enough for said bolt to pass into and out of said hole in the barn door.

3. The privacy lock of claim 1 wherein a handle is coupled to said lever, said lever pivotable relative to said lockcase;

wherein said bolt is coupled to said lever, at least indirectly, and translates when said lever pivots; and wherein a shuttle is located between said bolt and said lever, said shuttle sliding within said lockcase when said lever rotates.

4. The privacy lock of claim 3 wherein said lever includes a wheel rotating on a hub and with an arm extending from said wheel, said handle located on said arm of said lever, said wheel including at least one slot therein, said slot engaging a post on said shuttle to translate said shuttle when said wheel rotates in response to forces applied to said arm through said handle.

5. The privacy lock of claim 1 wherein fasteners mount said lockcase to the jamb of the doorway.

6. The privacy lock of claim 5 wherein said lockcase includes a base plate on a surface thereof, and wherein jamb screws pass through said base plate and into the jamb, said base plate of said lockcase located outside of the jamb and adjacent to the jamb.

* * * * *